US007328680B1

(12) United States Patent
Diamond

(10) Patent No.: US 7,328,680 B1
(45) Date of Patent: Feb. 12, 2008

(54) CYLINDER HEAD ASSEMBLY AND SPHERICAL VALVE FOR INTERNAL COMBUSTION ENGINES

(76) Inventor: Gary Diamond, 4914 SW. 27th Ave., Ft. Lauderdale, FL (US) 33312

( * ) Notice: Subject to any disclaimer, the term of this patent is extended or adjusted under 35 U.S.C. 154(b) by 0 days.

(21) Appl. No.: 11/493,399

(22) Filed: Jul. 26, 2006

(51) Int. Cl.
*F01L 7/00* (2006.01)

(52) U.S. Cl. ..... 123/190.14; 123/80 R; 251/315.01

(58) Field of Classification Search ..... 123/190.4, 123/190.8, 190.11, 190.14, 190.15, 80 R, 123/80 BA, 80 BD; 251/315.01
See application file for complete search history.

(56) References Cited

U.S. PATENT DOCUMENTS 2,048,134 A * 7/1936 Ludovico ..... 123/190.8
4,782,801 A * 11/1988 Ficht et al. ..... 123/190.8

* cited by examiner

*Primary Examiner*—Noah P. Kamen
(74) *Attorney, Agent, or Firm*—Gold & Rizvi, P.A.; Glenn E. Gold; H. John Rizvi

(57) ABSTRACT

A cylinder head assembly includes a spherical valve for an internal combustion engine having at least one cylinder defining a combustion chamber and housing a piston reciprocally movable therein throughout successive intake, compression, power, and exhaust strokes for facilitating the flow of engine gasses between a manifold and the combustion chamber. The cylinder head assembly comprises a cylinder head defining therein a spherical valve race in gaseous communication with the combustion chamber. A spherical valve is disposed in the spherical valve race and has a spherical body defining a central axis of rotation and further defining a passageway therethrough. The passageway has a first opening substantially coaxial with the central axis for gaseous communication with a manifold and has a second opening substantially transverse from the central axis. The spherical valve is rotatable in the spherical valve race about the central axis of rotation to selectively place the second opening in gaseous communication with the combustion chamber.

19 Claims, 4 Drawing Sheets

CYLINDER HEAD ASSEMBLY AND SPHERICAL VALVE FOR INTERNAL COMBUSTION ENGINES

BACKGROUND OF THE INVENTION

1. Field of the Invention

The present invention relates to valves for internal combustion engines and more particularly to spherical valves for transferring gasses to and from individual combustion chambers in internal combustion engines.

2. Discussion of the Related Art

Internal combustion engines require a valving system to deliver fuel-air mixtures to and to remove combustion gasses from individual combustion chambers in the engine. The majority of internal combustion engines in operation incorporate a valving system based on variations of a spring-loaded poppet valve wherein the spring normally biases the valve in a closed position. In the closed position, the head of the valve is seated against either an intake port or an exhaust port in each individual cylinder head. The valves themselves are usually positioned in the cylinder heads such that they normally operate in a substantially vertical orientation. A valve stem extends from the top of the valve through a guide in the cylinder head to contact a camshaft or alternatively, a rocker arm which in turn contacts the camshaft. The camshaft, in turn, is mechanically linked to and driven by the engine.

In operation, as the engine rotates, the camshaft is likewise rotated such that the individual cams on the camshaft operate on the valve stems either directly or through the linked rocker arms. As each valve is operated on by the camshaft, the normal bias of the spring is overcome to push the valve head into the individual combustion chambers of the engine thereby opening either an intake port or an exhaust port to permit transfer of intake or exhaust gasses. The valves must be pushed axially a sufficient distance and remain open for a sufficient time to permit the desired volume of gas to enter or be expelled from the cylinder.

Poppet valves have significant disadvantages. In some engines, to obtain the desired flow of intake or exhaust gasses, the valve heads in their extended open position extend below the extreme upward or top dead center of the piston. Thus, timing of the valve operation has distinct limitations and becomes critical to prevent the piston from striking the valve head in its open position and causing extensive damage to the engine.

Poppet valve configurations have an extensive collection of hardware and components to complete the assembly and operation of the valving system. These items include springs, cotters, guides, rockers, camshafts, pushrods, lifters, and the valves themselves. Many internal combustion engines now incorporate multiple valve systems wherein there is more than one intake valve per cylinder and more than one exhaust valve per cylinder thereby increasing the complexity and number of individual parts attributable to the valve system. Additionally, some engines also incorporate multiple camshafts. The number and complexity of the valve system components increases the cost of the engine and the cost of repair.

In conventional internal combustion engines the spring biasing the poppet valve in its closed position is relatively stiff to insure the closing and seating of the valve head at the desired time. Therefore, the force required to overcome the spring to open the valve is quite large and correspondingly reduces the efficiency of the engine. The stiffness of the spring may also limit the timing events of the engine and thus further limit its efficiency and performance. Additionally, at high speeds an engine can experience valve float. Valve float occurs when the engine speed exceeds the ability of the valve spring to close the valve prior to the completion of the intake or exhaust stroke thereby causing engine power to diminish.

Yet another disadvantage of using conventional poppet valves is that even in the open position, the valve partially obstructs the port through which the gasses flow. Additionally, the valve head is directly below the port and thus the gas must flow around the valve head rather than flow directly into or out of the combustion chamber. This is especially critical for the intake valve since the obstruction of the valve head can cause turbulence and dead spaces within the cylinder thereby decreasing the combustion efficiency and thereby engine efficiency.

Thus what is desired is a valve system for internal combustion engines that reduces the number and complexity of parts, and does not restrict or disrupt the flow of gasses into or out of the combustion chambers of the engine.

SUMMARY OF THE INVENTION

One aspect of the present invention is a spherical valve for an internal combustion engine. The spherical valve includes a spherical body defining a central axis of rotation and a passageway therethrough. The passageway has a first opening substantially coaxial with the central axis and a second opening substantially transverse from the central axis. A drive axle is affixed to the spherical body and is coaxial with the central axis. A support sleeve is also coaxial with the central axis and extends from the first opening.

Another aspect of the present invention is a cylinder head assembly including a spherical valve for an internal combustion engine having at least one cylinder defining a combustion chamber and housing a piston reciprocally movable therein throughout successive intake, compression, power, and exhaust strokes for facilitating the flow of engine gasses between a manifold and the combustion chamber. The cylinder head assembly comprises a cylinder head defining therein a spherical valve race in gaseous communication with the combustion chamber. A spherical valve is disposed in the spherical valve race and has a spherical body defining a central axis of rotation and further defining a passageway therethrough. The passageway has a first opening substantially coaxial with the central axis for gaseous communication with a manifold and has a second opening substantially transverse from the central axis. The spherical valve is rotatable in the spherical valve race about the central axis of rotation to selectively place the second opening in gaseous communication with the combustion chamber.

Yet another aspect of the present invention is a cylinder head assembly for an internal combustion engine having at least one cylinder defining a combustion chamber and housing a piston reciprocally movable therein throughout successive intake, compression, power, and exhaust strokes for facilitating the flow of engine gasses into the combustion chamber from an intake manifold during the intake stroke and the removal of exhaust gases from the combustion chamber to an exhaust manifold during the exhaust stroke. The cylinder head assembly includes a cylinder head defining therein a spherical intake valve race and a spherical exhaust race. The spherical intake valve race defines an intake port for gaseous communication with the combustion chamber, and the spherical exhaust valve race further defines an exhaust port for gaseous communication with the combustion chamber. A spherical intake valve is rotatably disposed in the spherical intake valve race wherein the spherical intake valve includes a spherical body having a drive axle extending therefrom and defines a central axis of rotation. The spherical body further defines a passageway therethrough wherein the passageway has a first opening substantially coaxial with the central axis for gaseous communication with an intake manifold and has a second opening substantially transverse from the central axis for gaseous communication with the intake port. A spherical exhaust valve is rotatably disposed in the spherical exhaust valve race. The spherical exhaust valve includes a spherical body having a drive axle extending therefrom and defining a central axis of rotation. The spherical body further defines a passageway therethrough wherein the passageway has a first opening substantially coaxial with the central axis for gaseous communication with an exhaust manifold and has a second opening substantially transverse from the central axis for gaseous communication with the exhaust port. The spherical intake valve and the spherical exhaust valve are linked for rotation in unison such that the spherical intake valve transverse opening is substantially in registration with the intake port and the exhaust valve spherical body seals the exhaust port during the engine intake stroke. Similarly, the spherical exhaust valve transverse opening is substantially in registration with the exhaust port and the intake valve spherical body seals the intake port during the engine exhaust stroke.

These and other advantages of the invention will be further understood and appreciated by those skilled in the art by reference to the following written specification, claims and appended drawings.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENT

Figure 6:
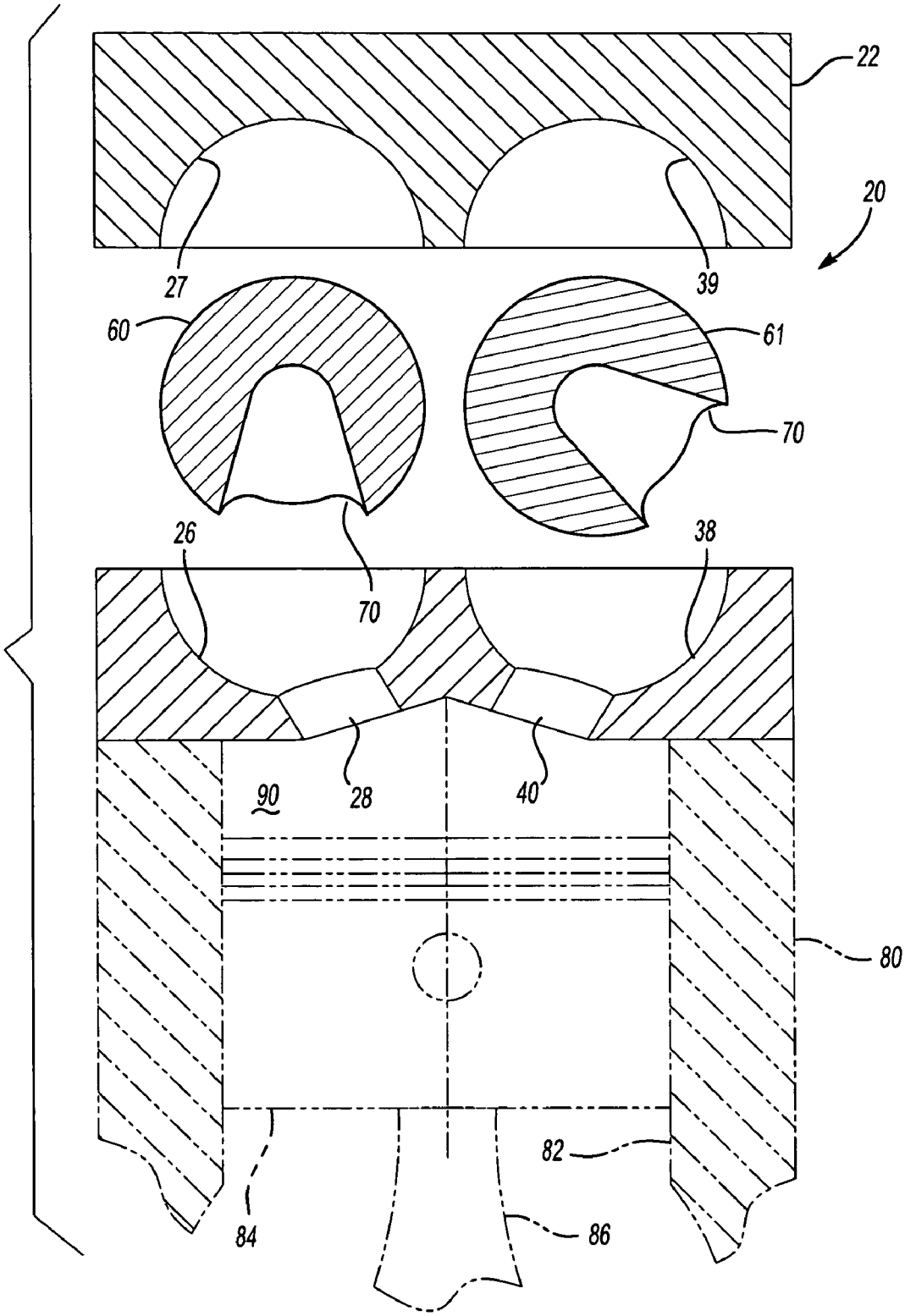
FIG. 6 is a cross-sectional exploded elevation view of the cylinder head and spherical valves shown in relation to a piston.

For purposes of description herein, the terms "upper", "lower", "left", "rear", "right", "front", "vertical", "horizontal", and derivatives thereof shall relate to the invention as oriented in FIG. 6. However, one will understand that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
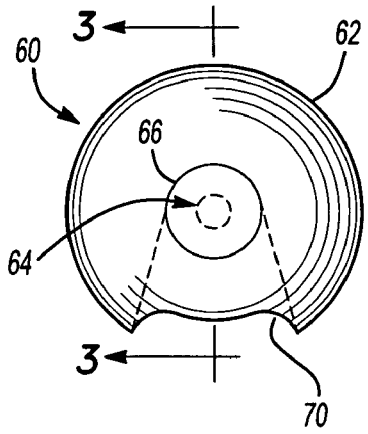
FIG. 2 is a front elevation view of one of the spherical valves.
Figure 3:
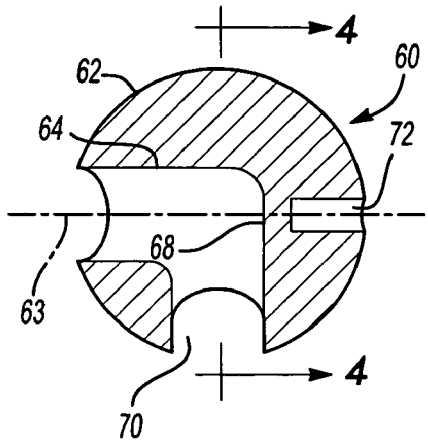
FIG. 3 is a cross-sectional view of the spherical valve shown in FIG. 2 and taken along the line 3-3, FIG. 2.
Figure 4:
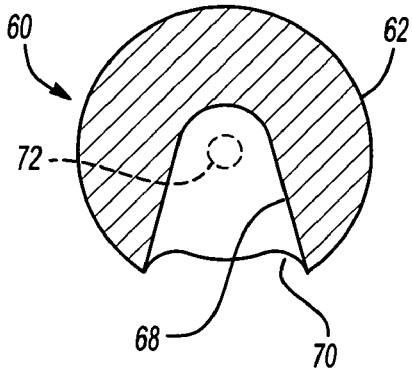
FIG. 4 is a cross-sectional view of the spherical valve shown in FIG. 3 and taken along the line 4-4, FIG. 3.

Turning to the drawings, and first to FIGS. 2-4, a spherical valve 60 includes a spherical body 62 and has a central axis 63 for the body 62 to be rotated about. Coaxial with axis 63 an axial opening 66 leads to axial duct 64 defined by spherical body 62. A transverse duct 68 internally connects with axial duct 64 and terminates at transverse opening 70 to form a continuous passageway through spherical body 62. Transverse duct 68 can have a cross-sectional area that gradually increases from axial duct 64 to transverse duct 70 such that transverse opening 70 is larger than axial opening 66. Transverse opening 70 is typically elongate in shape with a minor dimension substantially equal to the diameter of axial duct 64 and a major dimension greater than the diameter of axial duct 64. Spherical body 62 also has a drive axle receptacle 72 coaxial with central axis 63 and diametrically opposite from axial opening 66.

Figure 5:
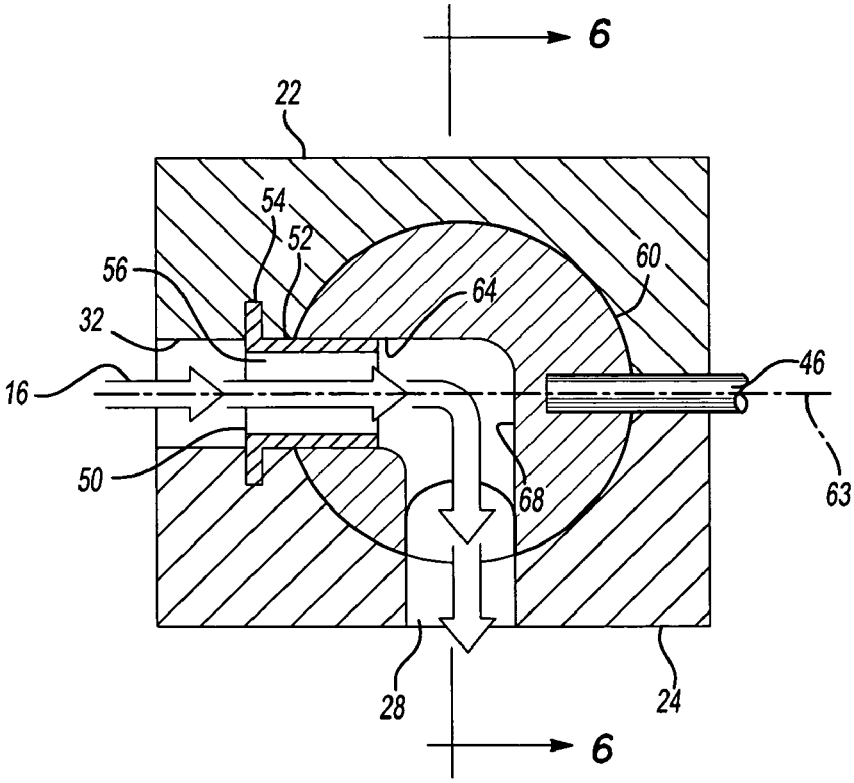
FIG. 5 is an side elevational cross-section of an assembled cylinder head and spherical intake valve showing the flow of a fuel-air mixture therethrough.

Referring to FIG. 5, valve 60 further includes a drive axle 46 affixed in drive axle receptacle 72 such that rotation of drive axle 46 about central axis 63 causes a like rotation of valve body 60 thereabout. A support sleeve 50 includes a cannular sleeve body 52 and a radially extending flange 54 defining a sleeve orifice 56. A portion of support sleeve cannular body 52 is received in axial duct 64 of spherical body 62.

Figure 1:
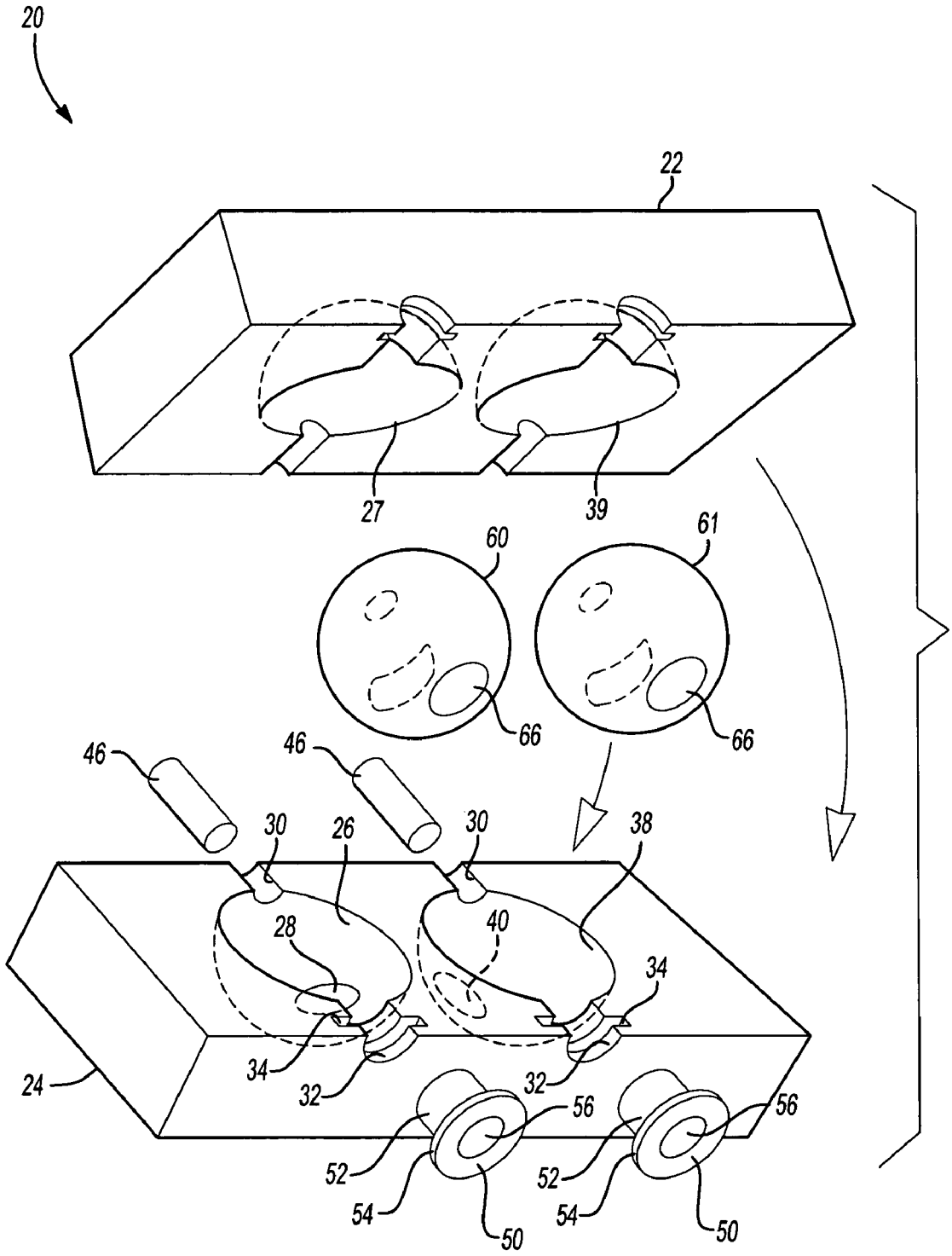
FIG. 1 is a perspective exploded view of a cylinder head incorporating spherical valves embodying the present invention, wherein one intake and one exhaust valve are shown.

FIGS. 1 and 5 illustrate a cylinder head assembly 20 including spherical valves which is one of the preferred embodiments of the present invention and illustrates its various components. An upper cylinder head 22 defines a hemispherically shaped upper intake valve race 27 and a hemispherically shaped upper exhaust valve race 39. Lower cylinder head 24 in like manner defines a hemispherically shaped lower intake valve race 26 and a hemispherically shaped lower exhaust valve race 38 wherein intake valve races 26, 27 are in registration one with the other and exhaust valve races 38, 39 are in registration one with the other. Lower intake valve race 26 further defines an intake port 28 at a lower portion thereof and lower exhaust valve race 38 defines an exhaust port 40 at a lower portion thereof. Upper and lower cylinder heads 22, 24 further define axle races 30 and sleeve support races 32. Sleeve support race 32 also includes a retaining groove 34. Alternatively, axial duct 64 in spherical body 62 can include a counterbore (not shown) for receiving cannular body 52 of support sleeve 50 such that orifice 56 of support sleeve 50 is substantially the same diameter as axial duct 64 and support sleeve race 32.

Intake valve races 26, 27 receive intake valve 60 therein and exhaust valve races 38, 39 receive exhaust valve 61 therein. In like manner, drive axle 46 of each of valves 60, 61 are received in axle races 30. Further, the portion of cannular sleeve body 52 is received in sleeve race 32 and flange 54 is received in groove 34 for each of spherical valves 60, 61. Drive axle 46 and support sleeve 50 support spherical body 62 for rotation about central axis 63. Orifice 56 of support sleeve 50 is axially aligned with sleeve race 32 for gaseous communication with a manifold.

As further illustrated in FIG. 6, cylinder head assembly 20 is affixed to engine block 80 and positioned above an engine cylinder 82 to define combustion chamber 90. Cylinder 82 has a piston 84 and connecting rod 86 reciprocally movable therein throughout successive intake, compression, power, and exhaust strokes for rotating a crankshaft (not shown) to deliver power generated by the piston 84. Intake port 28 can be angled toward a center of combustion chamber 90 for efficient distribution of a fuel-air mixture, and exhaust port 40 can likewise be angled toward a center of combustion chamber 90 for efficient removal of exhaust gasses. Spherical valves 60, 61 are linked to the operation of piston 86 via drive axles such that transverse openings 70 of valves 60, 61 are timed to be in registration with intake and exhaust ports 28, 40 to properly deliver a fuel air mixture to combustion chamber 90 during the intake stroke of piston 84 and to remove exhaust gasses from combustion chamber 90 during the exhaust stroke. Spherical valves 60, 61 can be linked directly by mechanical means such as with a toothed belt, a chain, or gears. Valves 60, 61 can also be independently rotated by synchronized electric motors which are electronically linked to and timed according to the cycle strokes of piston 84 utilizing an electronic processing device to determine the optimum valve timing according to varying engine conditions.

Figure 7A:
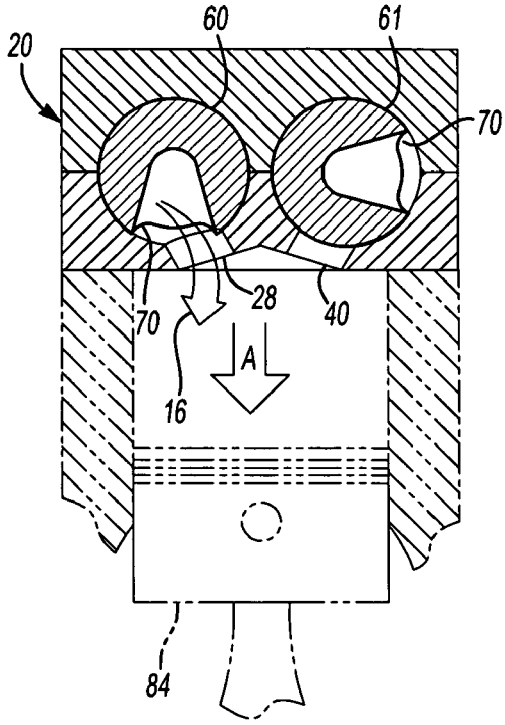
FIG. 7A is a cross-section elevation view of the valves and piston at the end of the intake stroke of the piston.

Turning now to FIGS. 7A through 7D, the different piston strokes are illustrated showing the relative positions of spherical intake and exhaust valves 60, 61. FIG. 7A illustrates the intake stroke of piston 84. Fuel air mixture 16 flows through spherical intake valve 60 and transverse opening 70 through intake port 28 into combustion chamber 90 as piston 84 descends according to arrow 'A' during its intake stroke. Spherical exhaust valve 61 is at a rotational position sealing off exhaust port 40 to prevent the escape of gasses from combustion chamber 90.

Figure 7B:
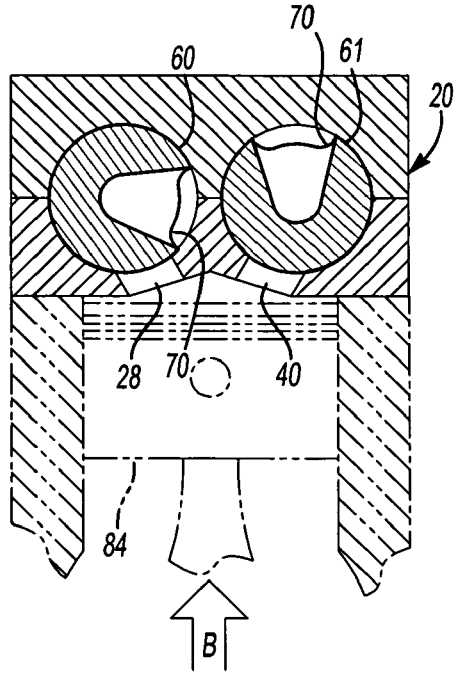
FIG. 7B is a cross-section elevation view of the valves and piston at the end of the compression stroke of the piston.

FIG. 7B illustrates the compression stroke of piston 84 wherein both spherical valves 60, 61 have advanced in a counterclockwise direction and are rotationally positioned to prevent the escape of gasses from combustion chamber 90 thereby facilitating the compression of the fuel-air mixture as piston 84 ascends according to arrow 'B.'

Figure 7C:
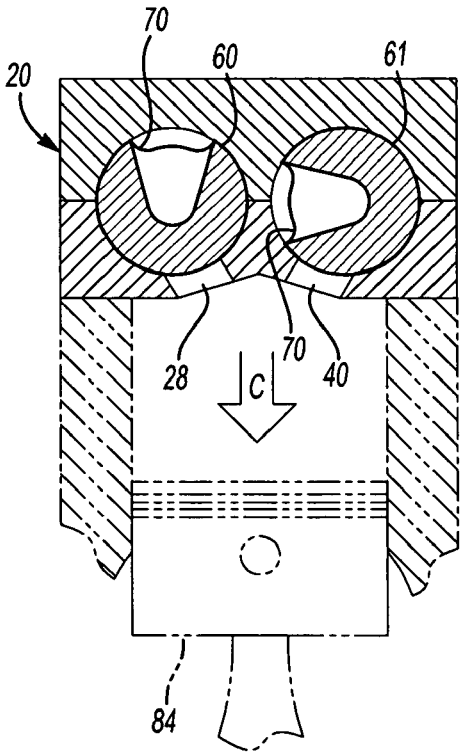
FIG. 7C is a cross-section elevation view of the valves and piston at the end of the power stroke of the piston.

FIG. 7C illustrates the power stroke wherein the expanding combustion gasses cause piston 84 to descend according to arrow 'C' after combustion of the fuel-air mixture. While spherical valves 60, 61 have continued their counterclockwise rotation, both valves 60, 61 are rotationally positioned to prevent the escape of gasses from combustion chamber 90 thereby facilitating the powering of piston 84 during its power stroke.

Figure 7D:
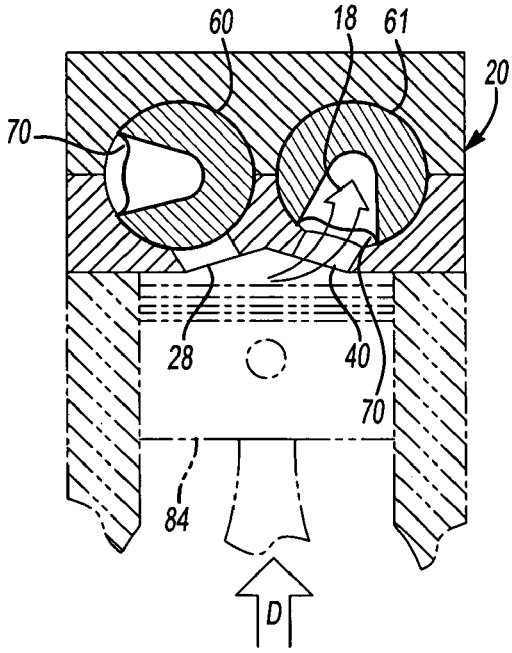
FIG. 7D is a cross-section elevation view of the valves and piston at the end of the exhaust stroke of the piston.

FIG. 7D illustrates the exhaust stroke of piston 84 wherein counterclockwise advancing spherical intake valve 60 continues to seal intake port 28 thus preventing exhaust gasses from being transferred through valve 60 and into the intake manifold. However, spherical exhaust valve 61 has rotated counterclockwise to place transverse opening 70 in registration with exhaust port 40 so that exhaust gasses 18 can be forced from combustion chamber 90 through spherical valve 61 and into the exhaust manifold prior to repeating the intake, compression, power, and exhaust strokes of another engine cycle.

In the foregoing description those skilled in the art will readily appreciate that modifications may be made to the invention without departing from the concepts disclosed herein. Such modifications are to be considered as included in the following claims, unless these claims state otherwise.

What is claimed is:

1. A cylinder head assembly for an internal combustion engine having at least one cylinder housing a piston reciprocally movable-therein throughout successive intake, compression, power, and exhaust strokes and further defining a combustion chamber at a top of said cylinder, and for facilitating the flow of engine gasses between a manifold and the combustion chamber, said cylinder head assembly comprising:

a cylinder head defining therein a spherical valve race in gaseous communication with the combustion chamber; and a spherical valve having a spherical body defining a central axis of rotation and further defining a solitary passageway therethrough, said passageway having a first opening substantially coaxial with said central axis for gaseous communication with a manifold and a second opening substantially transverse from said central axis, said spherical valve rotatable in said spherical valve race about said central axis of rotation to selectively place said second opening in gaseous communication with the combustion chamber.

2. The cylinder head assembly according to claim 1 wherein said passageway comprises a first portion coaxial to said central axis and a second portion transverse to said central axis.

3. The cylinder head assembly according to claim 2 wherein said second transverse passageway portion has a cross-sectional area at least partially greater than said, first coaxial passageway portion.

4. The cylinder head assembly according to claim 3 wherein said transverse opening is elongate having a major axis oriented in a direction of rotation of said spherical valve.

5. The cylinder head assembly according to claim 1 wherein said support sleeve includes a radially extending flange at an end opposite from said spherical body.

6. The cylinder head assembly according to claim 5 wherein said support sleeve is at least partially received in said coaxial opening of said spherical body.

7. The cylinder head assembly according to claim 6 wherein said spherical body includes a counterbore at said coaxial opening, said counterbore receiving a portion of said support sleeve.

8. The cylinder head assembly according to claim 7 wherein said support sleeve defines a passageway therethrough, said support sleeve passageway having a cross-sectional area substantially equal to a cross-sectional area of said passageway.

9. A cylinder head assembly for an internal combustion engine having at least one cylinder housing a piston reciprocally movable therein throughout successive intake, compression, power, and exhaust strokes and further defining a combustion chamber at a top of said cylinder, and for facilitating the flow of engine gasses between a manifold and the combustion chamber, said cylinder head assembly comprising:

a cylinder head defining therein a spherical valve race in gaseous communication with the combustion chamber;

a spherical valve having a spherical body defining a central axis of rotation and further defining a passageway therethrough, said passageway having a first opening substantially coaxial with said central axis for gaseous communication with a manifold and a second opening substantially transverse from said central axis, said spherical valve rotatable in said spherical valve race about said central axis of rotation to selectively place said second opening in gaseous communication with the combustion chamber; and further wherein:

said cylinder head defines an axle race substantially coaxial with said central axis of said spherical body and said spherical valve includes a drive axle affixed to said spherical body and received in said axle race.

10. The cylinder head assembly according to claim 9 wherein said cylinder head defines a sleeve race substantially coaxial with said central axis of said spherical body and further wherein said spherical valve includes a support sleeve extending from said first opening in said spherical body and received in said sleeve race.

11. The cylinder head assembly according to claim 10 wherein said passageway in said spherical body comprises a first portion coaxial to said central axis and a second portion transverse to said central axis.

12. The cylinder head assembly according to claim 11 wherein said second transverse passageway portion has a cross-sectional area at least partially greater than said first coaxial passageway portion.

13. The cylinder head assembly according to claim 12 wherein said transverse opening is elongate having a major axis oriented in a direction of rotation of said spherical valve.

14. The cylinder head assembly according to claim 11 wherein said sleeve race further defines a retaining groove and wherein said support sleeve includes a radially extending flange at an end opposite from said spherical body, said radially extending flange received in said retaining groove.

15. The cylinder head assembly according to claim 14 wherein said support sleeve is at least partially received in said coaxial opening of said spherical body.

16. The cylinder head assembly according to claim 15 wherein said spherical body includes a counterbore at said coaxial opening, said counterbore receiving a portion of said support sleeve.

17. The cylinder head assembly according to claim 16 wherein said support sleeve defines a passageway therethrough, said support sleeve passageway having a cross-sectional area substantially equal to a cross-sectional area of said coaxial passageway.

18. The cylinder head assembly according to claim 10 wherein said cylinder head comprises:

an upper cylinder head defining at least a portion of said spherical valve race, a portion of said axle race, and a portion of said sleeve race; and a bottom cylinder head defining at least a portion of said spherical valve race, said gaseous communication with the combustion chamber, a portion of said axle race, and a portion of said sleeve race.

19. A cylinder head assembly for an internal combustion engine having at least one cylinder housing a piston reciprocally movable therein throughout successive intake, compression, power, and exhaust strokes and further defining a combustion chamber at a top of said cylinder, and for alternately facilitating the inflow of intake air from an intake manifold during the intake stroke and the removal of exhaust gases from the combustion chamber to an exhaust manifold during the exhaust stroke, said cylinder head assembly comprising:

a cylinder head defining therein a spherical intake valve race and a spherical exhaust race wherein said spherical intake valve race further defines an intake port for gaseous communication with the combustion chamber and further wherein said spherical exhaust valve race further defines an exhaust port for gaseous communication with the combustion chamber;

a spherical intake valve rotatably disposed in said spherical intake valve race, said spherical intake valve including a spherical body having a drive axle extending therefrom and defining a central axis of rotation, said spherical body further defining a passageway therethrough wherein said passageway has a first opening substantially coaxial with said central axis for gaseous communication with an intake manifold and a second opening-substantially transverse from said central axis for gaseous communication with said intake port; and a spherical exhaust valve rotatably disposed in said spherical exhaust-valve race, said spherical exhaust valve including a spherical body having a drive axle extending therefrom and defining a central axis of rotation, said spherical body further defining a passageway therethrough wherein said passageway has a first opening substantially coaxial with said central axis for gaseous communication with an exhaust manifold and a second opening substantially transverse from said central axis for gaseous communication with said exhaust port combustion chamber; wherein:

said spherical intake valve and said spherical exhaust valve are linked for rotation in unison such that said spherical intake valve transverse opening is substantially in registration with said intake port and said exhaust valve spherical body seals said exhaust port during the engine intake stroke, and such that said spherical exhaust valve transverse opening is substantially in registration with said exhaust port and said intake spherical body seals said intake port during the engine exhaust stroke.

* * * * *